US010458032B2

(12) United States Patent
Lipschutz

(10) Patent No.: US 10,458,032 B2
(45) Date of Patent: Oct. 29, 2019

(54) ENVIRONMENTALLY FRIENDLY NICKEL ELECTROPLATING COMPOSITIONS AND METHODS

(71) Applicant: Rohm and Haas Electronic Materials LLC, Marlborough, MA (US)

(72) Inventor: Michael Lipschutz, Natick, MA (US)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 75 days.

(21) Appl. No.: 15/947,949

(22) Filed: Apr. 9, 2018

(65) Prior Publication Data

US 2018/0363156 A1 Dec. 20, 2018

Related U.S. Application Data

(60) Provisional application No. 62/519,958, filed on Jun. 15, 2017.

(51) Int. Cl.

| | |
|---|---|
| ***C25D 3/18*** | (2006.01) |
| ***C23C 18/36*** | (2006.01) |
| ***C23C 28/00*** | (2006.01) |
| ***C25D 3/12*** | (2006.01) |

(52) U.S. Cl.

CPC ..... *C25D 3/12* (2013.01)

(58) Field of Classification Search

CPC ..... C23C 18/32; C23C 18/1653; C23C 28/01; C23C 28/023; C25D 3/18

USPC ..... 106/1.27; 205/279, 191

See application file for complete search history.

(56) References Cited

U.S. PATENT DOCUMENTS

| | | | | |
|---|---|---|---|---|
| 3,206,383 | A * | 9/1965 | Kappel | C25D 3/18 205/279 |
| 4,138,294 | A | 2/1979 | Arcilesi | |
| 2018/0272808 | A1 | 9/2018 | Nishino | |

FOREIGN PATENT DOCUMENTS

| | | | |
|---|---|---|---|
| CA | 1175386 | A | 10/1984 |
| EP | 136499 | A1 | 4/1985 |

OTHER PUBLICATIONS

Search report for corresponding Europe Application No. 18 17 7422 dated Nov. 5, 2018.

* cited by examiner

*Primary Examiner* — Edna Wong

(74) *Attorney, Agent, or Firm* — John J. Piskorski

(57) ABSTRACT

Environmentally friendly nickel electroplating compositions enable the electroplating of nickel deposits which are bright and uniform and inhibit corrosion of gold layers deposited on the bright and uniform nickel deposits. The environmentally friendly nickel electroplating compositions can be used to electroplate bright and uniform nickel deposits on various substrates over a wide current density range.

14 Claims, 5 Drawing Sheets

ENVIRONMENTALLY FRIENDLY NICKEL ELECTROPLATING COMPOSITIONS AND METHODS

FIELD OF THE INVENTION

The present invention is directed to environmentally friendly nickel electroplating compositions and methods. More specifically, the present invention is directed to environmentally friendly nickel electroplating compositions and methods for electroplating nickel on substrates over a wide current density range where the nickel deposits are bright and uniform and whose properties can inhibit pore formation in subsequently plated gold and gold alloy layers, thus preventing corrosion of plated articles when the nickel deposits are used as underlayers.

BACKGROUND OF THE INVENTION

Bright nickel electroplating baths are used in the automotive, electrical, appliance, hardware and various other industries. One of the most commonly known and used nickel electroplating baths is the Watts bath. A typical Watts bath includes nickel sulfate, nickel chloride and boric acid. The Watts bath typically operates at a pH range of 2-5.2, a plating temperature range of 30-70° C. and a current density range of 1-6 amperes/$dm^2$. Nickel sulfate is included in the baths in comparatively large amounts to provide the desired nickel ion concentration. Nickel chloride improves anode corrosion and increases conductivity. Boric acid is used as a weak buffer to maintain the pH of the bath. In order to achieve bright and lustrous deposits, organic and inorganic brightening agents are often added to the baths.

A common problem with most metal plating baths is recovery of the bath components and disposal of breakdown products after use. While some bath components may be readily recovered, although recovery processes may be costly, other components and break-down products may be difficult to recover and are discharged in waste water, thus potentially contaminating the environment. In the case of the Watts bath, nickel sulfate and nickel chloride may be readily recovered; however, recovery of boric acid is challenging and often ends up in waste water contaminating the environment.

Many governments around the world are passing stricter environmental laws and regulations with respect to how chemical waste is treated and the types of chemicals industries may use in development and manufacturing processes. For example, in the European Union the regulation Registration, Evaluation, Authorization and Restriction of Chemicals, known as REACh, has banned numerous chemicals or is in the process of banning chemicals such as boric acid from substantial industrial use. Accordingly, the metal plating industries which manufacture and sell electroplating baths which typically include boric acid have attempted to develop boric acid free baths. In the case of nickel electroplating baths, many manufacturers have tried to address the problem of developing a nickel electroplating bath free of boric acid with substantially the same plating performance by substituting the boric acid with nickel acetate. Unfortunately, nickel acetate baths often produce rough and insufficiently dense nickel deposits which vary in appearance depending on the current density applied. In addition, depending on the amount included in the nickel baths, nickel acetate based baths may generate an offensive odor, thus compromising the working environment.

Another compound typically included in nickel electroplating baths to improve plating performance which is now frowned upon by the governments of many countries is coumarin has been included in nickel plating baths to provide a high-leveling, ductile, semi-bright and sulfur-free nickel deposits from a Watts bath. Leveling refers to the ability of the nickel deposit to fill in and smooth out surface defects such as scratches and polish lines. An example of a typical nickel plating bath with coumarin contains about 150-200 mg/L coumarin and about 30 mg/L formaldehyde. A high concentration of coumarin in the bath provides very good leveling performance; however, such performance is short-lived. Such high coumarin concentrations result in a high rate of detrimental breakdown products. The breakdown products are undesirable because they can cause non-uniform, dull gray areas in the deposit that are not easily brightened by subsequent bright nickel deposits. They can reduce the leveling performance of the nickel bath as well as reduce other beneficial physical properties of the nickel deposit. To address the problem workers in the industry have proposed to reduce the coumarin concentrations and add formaldehyde and chloral hydrate; however, use of such additives in moderate concentrations not only increases tensile stress of the nickel deposits but also compromises leveling performance of the baths. Further, formaldehyde, as boric acid and coumarin, is another compound which many government regulations, such as REACh, consider harmful to the environment.

It is important to provide highly leveled nickel deposits without sacrificing deposit ductility and internal stress. The internal stress of the plated nickel deposit can be compressive stress or tensile stress. Compressive stress is where the deposit expands to relieve the stress. In contrast, tensile stress is where the deposit contracts. Highly compressed deposits can result in blisters, warping or cause the deposit to separate from the substrate, while deposits with high tensile stress can also cause warping in addition to cracking and reduction in fatigue strength.

As briefly mentioned above, nickel electroplating baths are used in a variety of industries. Nickel electroplating baths are typically used in electroplating nickel layers on electrical connectors and leadframes. Such articles have irregular shapes and are composed of metal such as copper and copper alloys with relatively rough surfaces. Therefore, during nickel electroplating, the current density is non-uniform across the articles often resulting in nickel deposits which are unacceptably non-uniform in thickness and brightness across the articles.

Another important function of nickel electroplating baths is to provide a nickel underlayer for gold and gold alloy deposits to prevent the corrosion of underlying metals plated with gold and gold alloy. Prevention of gold and gold alloy pore formation which leads to corrosion of underlying metals is a challenging problem. The pore formation of gold and gold alloy plated articles has been especially problematic in the electronic materials industry where corrosion can lead to faulty electrical contacts between components in electronic devices. In electronics gold and gold alloys are used as solderable and corrosion resistant surfaces for contacts and connectors. Gold and gold alloy layers are also used in lead finishes for integrated circuit (IC) fabrication. However, certain physical properties of gold, such as its relative porosity, translate into problems when gold is deposited on a substrate. For instance, gold's porosity can create interstices on the plated surface. These small spaces can contribute to corrosion or actually accelerate corrosion through the galvanic coupling of the gold layer with the underlying base metal layer. This is believed to be due to the base metal substrate and any accompanying underlying metal layers which may be exposed to corrosive elements via the pores in the gold outer surface.

In addition, many applications include thermal exposure of coated leadframes. Diffusion of metal between layers under thermal aging conditions may cause a loss of surface quality if an underlying metal diffuses into a noble metal surface layer.

At least three different approaches of overcoming the corrosion problems have been attempted: 1) reducing the porosity of the coating, 2) inhibiting the galvanic effects caused by the electropotential differences of different metals, and 3) sealing the pores in the electroplated layer. Reducing the porosity has been studied extensively. Pulse plating of the gold and utilization of various wetting/grain refining agents in the gold plating bath affect the gold structure and are two factors contributing to a reduction in gold porosity. Often regular carbon bath treatments and good filtration practices in the series of electroplating baths or tanks combined with a preventive maintenance program help to maintain gold metal deposition levels and correspondingly low levels of surface porosity. A certain degree of porosity, however, continues to remain.

Pore closure, sealing and other corrosion inhibition methods have been tried but with limited success. Potential mechanisms using organic precipitates having corrosion inhibitive effects are known in the art. Many of these compounds were typically soluble in organic solvents and were deemed not to provide long term corrosion protection. Other methods of pore sealing or pore blocking are based on the formation of insoluble compounds inside pores.

In addition to the problem of pore formation, exposing gold to elevated temperatures, such as in thermal aging, undesirably increases the gold's contact resistance. This increase in contact resistance compromises the performance of the gold as a conductor of current. In theory, workers believe that this problem arises from the diffusion of organic materials co-deposited with the gold to the contact surfaces. Various techniques for obviating this problem have been attempted heretofore, typically involving electrolytic polishing. However, none have proven completely satisfactory for this purpose and investigative efforts continue.

Accordingly, there is a need for nickel electroplating compositions and methods to provide bright and uniform nickel deposits, even across a wide current density range, good ductility and which can be used as underlayers to reduce or inhibit pitting and pore formation in gold and gold alloy layers, thus preventing corrosion of underlying metal.

SUMMARY OF THE INVENTION

The present invention is directed to nickel electroplating compositions including one or more sources of nickel ions, one or more sources of acetate ions, sodium saccharinate and one or more N-benzylpyridinium sulfonate compounds having formula:

(I)

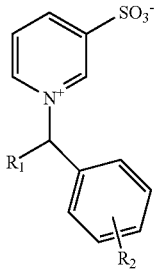

wherein $R_1$ and $R_2$ are independently chosen from hydrogen, hydroxyl and ($C_1$-$C_4$) alkyl.

The present invention is also directed to methods of electroplating nickel metal on a substrate including:

a) providing the substrate;

b) contacting the substrate with a nickel electroplating composition comprising one or more sources of nickel ions, one or more sources of acetate ions, sodium saccharinate and one or more N-benzylpyridinium sulfonate compounds having formula:

(I)

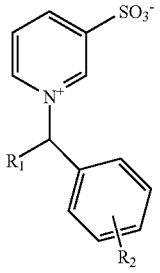

wherein $R_1$ and $R_2$ are independently chosen from hydrogen, hydroxyl and ($C_1$-$C_4$) alkyl; and c) applying an electric current to the nickel electroplating composition and substrate to electroplate a bright and uniform nickel deposit adjacent the substrate.

The aqueous nickel electroplating compositions are environmentally friendly. The electroplated nickel deposits are bright and uniform with good leveling. In addition, the bright and uniform nickel deposits can have good internal stress properties such as reduced tensile stress and good compressive stress such that the nickel deposits adhere well to substrates on which they are plated. The nickel deposits electroplated from the environmentally friendly aqueous nickel electroplating compositions can have good ductility. Further, the nickel electroplating compositions can electroplate bright and uniform nickel deposits over a wide current density range even on irregular shaped articles such as electrical connectors and leadframes. The bright and uniform electroplated nickel deposits can be used as nickel underlayers for gold and gold alloy layers to inhibit pitting and pore formation in the gold and gold alloys, thus preventing corrosion of metals beneath the gold and gold alloy layers.

DETAILED DESCRIPTION OF THE INVENTION

Figure 1:
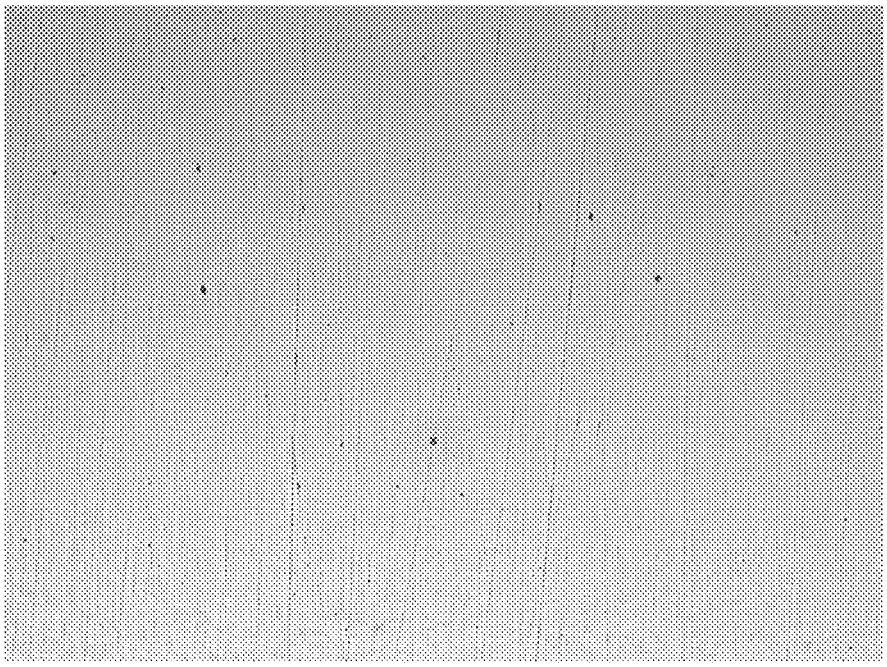
FIG. 1 is a photograph at 50× of a brass panel nickel plated with a nickel electroplating bath of the invention.

As used throughout the specification the abbreviations have the following meanings, unless the context clearly indicates otherwise: ° C.=degrees Centigrade; g=gram; mg=milligram; ppm=mg/L; L=liter; mL=milliliter; cm=centimeter; μm=microns; DI=deionized; A=amperes; ASD=amperes/$dm^2$=plating speed; DC=direct current; UV=ultraviolet; lbf=pound-force=4.44822162N; N=newtons; psi=pounds per square inch=0.06805 atmospheres; 1 atmosphere=$1.01325\times10^6$ dynes/square centimeter; wt %=weight percent; v/v=volume to volume; XRF=X-ray fluorescence; SEM=scanning electron micrograph; rpm=revolutions per minute; ASTM=American standard testing method; and GIMP=GNU Image Manipulation Program.

The term "adjacent" means directly in contact with such that two metal layers have a common interface. The term "zwitterion" (formerly called a "dipolar ion)" means a neutral molecule having positively and negatively charged groups and is often referred to as an inner salt. The term "aqueous" means water or water-based. The term "leveling" means an electroplated deposit has the ability to fill in and smooth out surface defects such as scratches or polish lines. The term "matte" means dull in appearance. The term "pit" or "pitting" or "pore" means a hole or orifice which may penetrate completely through a substrate. The term "dendrite" means a crystalline material with branching structures. The terms "composition" and "bath" are used interchangeably throughout the specification. The terms "deposit" and "layer" are used interchangeably throughout the specification. The terms "electroplating", "plating" and "depositing" are used interchangeably throughout the specification. The terms "a" and "an" can refer to both the singular and the plural throughout the specification. All numerical ranges are inclusive and combinable in any order, except where it is logical that such numerical ranges are constrained to add up to 100%.

The present invention is directed to environmentally friendly aqueous nickel electroplating compositions and methods for electroplating nickel on substrates which provide bright and uniform nickel deposits wherein the environmentally friendly aqueous nickel electroplating compositions include one or more N-benzylpyridinium sulfonate zwitterion compounds. The nickel electroplating compositions can electroplate bright and uniform nickel deposits over a wide current density range even on irregular shaped articles such as electrical connectors and leadframes. The environmentally friendly aqueous nickel electroplating compositions have good leveling performance and the bright and uniform nickel deposits plated from the environmentally friendly aqueous nickel electroplating compositions have good internal stress properties and good ductility.

The one or more N-benzylpyridinium sulfonate compounds have a formula:

(I)

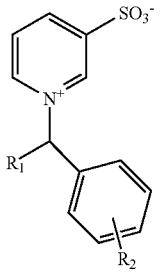

wherein $R_1$ and $R_2$ are independently chosen from hydrogen, hydroxyl and ($C_1$-$C_4$)alkyl. Preferably, $R_1$ and $R_2$ are independently chosen from hydrogen, hydroxyl and ($C_1$-$C_2$)alkyl, more preferably, $R_1$ and $R_2$ are independently chosen from hydrogen, hydroxyl and methyl. Even more preferably, $R_1$ and $R_2$ are independently chosen from hydrogen and hydroxyl, most preferably, $R_1$ and $R_2$ are hydrogen. An example of a most preferred N-benzylpyridinium sulfonate zwitterion compound is N-benzylpyridinium-3-sulfonate.

The one or more N-benzylpyridinium sulfonate compounds are included in the environmentally friendly aqueous nickel electroplating compositions in amounts of at least 0.5 ppm, preferably, in amounts of 5 ppm to 400 ppm, even more preferably, in amounts of 10 ppm to 300 ppm, still more preferably, from 50 ppm to 300 ppm, even further preferably, in amounts of 100 ppm to 300 ppm and most preferred from 150 ppm to 250 ppm.

One or more sources of nickel ions are included in the aqueous nickel electroplating compositions in sufficient amounts to provide nickel ion concentrations of at least 25 g/L, preferably, from 30 g/L to 150 g/L, more preferably, from 35 g/L to 125 g/L, even more preferably, from 40 g/L to 100 g/L, still even more preferably, from 45 g/L to 95, g/L, still further preferably, from 50 g/L to 90 g/L, and most preferably, from 50 g/L to 80 g/L.

One or more sources of nickel ions include nickel salts which are soluble in water. One or more sources of nickel ions include, but are not limited to, nickel sulfate and its hydrated forms nickel sulfate hexahydrate and nickel sulfate heptahydrate, nickel sulfamate and its hydrated form nickel sulfamate tetrahydrate, nickel chloride and its hydrated form nickel chloride hexahydrate, and nickel acetate and its hydrated from nickel acetate tetrahydrate. The one or more sources of nickel ions are included in the environmentally friendly aqueous nickel electroplating compositions in sufficient amounts to provide the desired nickel ion concentrations disclosed above. Nickel acetate or its hydrated form can be included in the aqueous nickel electroplating compositions, preferably, in amounts of 15 g/L to 45 g/L, more preferably, from 20 g/L to 40 g/L. When nickel sulfate is included in the aqueous nickel electroplating compositions, preferably, nickel sulfamate or its hydrated form, is excluded. Nickel sulfate can be included in the aqueous nickel electroplating compositions, preferably, in amounts of 100 g/L to 550 g/L, more preferably, in amounts of 150 g/L to 350 g/L. When nickel sulfamate or its hydrated form is included in the aqueous nickel electroplating compositions they can be included in amounts, preferably, from 120 g/L to 675 g/L, more preferably, from 200 g/L to 450 g/L. Nickel chloride or its hydrated form can be included in the aqueous nickel electroplating compositions in amounts, preferably, from 0 to 22 g/L, more preferably, 5 g/L to 20 g/L, even more preferably, from 5 g/L to 15 g/L.

Sodium saccharinate is included in the aqueous nickel electroplating compositions in amounts of at least 0.1 g/L. Preferably, sodium saccharinate is included in amounts from 0.1 g/L to 5 g/L, more preferably, from 0.2 g/L to 3 g/L.

One or more sources of acetate ions are included in the aqueous nickel electroplating compositions. Sources of acetate ions include, but are not limited to, nickel acetate, nickel acetate tetrahydrate, alkali metal salts of acetate such as lithium acetate, sodium acetate and potassium acetate. A source of acetate ions is also acetic acid. When the alkali metal salts are included in the nickel electroplating compositions, preferably, one or more of sodium acetate and potassium acetate are chosen, more preferably, sodium acetate is chosen. Preferably sufficient amounts of one or more of the sources of acetate ion are added to the aqueous nickel electroplating composition to provide an acetate ion concentration of at least 5 g/L, preferably, 5 g/L to 30 g/L, more preferably, from 10 g/L to 25 g/L.

Optionally, one or more sources of chloride ions can be included in the aqueous nickel electroplating composition. Sufficient amounts of one or more sources of chloride ions can be added to the aqueous nickel electroplating composition to provide a chloride ion concentration from 0 to 20 g/L, preferably, 0.5 to 20 g/L, more preferably, from 1 g/L to 15 g/L, even more preferably, from 2 g/L to 10 g/L. When nickel electroplating is done using insoluble anodes, such as insoluble anodes containing platinum or platinized titanium, preferably, the nickel electroplating composition is free of chloride. Sources of chloride include, but are not limited to, nickel chloride, nickel chloride hexahydrate, hydrogen chloride, alkali metal salts such as sodium chloride and potassium chloride. Preferably the source of chloride is nickel chloride and nickel chloride hexahydrate. Preferably, chloride is included in the aqueous nickel electroplating compositions.

The aqueous nickel electroplating compositions of the invention are acidic and the pH can, preferably, range from 2 to 6, more preferably, from 3 to 5.5, even more preferably, from 4 to 5.1. Inorganic acids, organic acids, inorganic bases or organic bases can be used to buffer the aqueous nickel electroplating compositions. Such acids include, but are not limited to, inorganic acids such as sulfuric acid, hydrochloric acid, sulfamic acid and boric acid. Organic acids such as acetic acid, amino acetic acid and ascorbic acid can be used. Inorganic bases such as sodium hydroxide and potassium hydroxide and organic bases such as various types of amines can be used. Preferably, the buffers are chosen from acetic acid and amino acetic acid. Most preferably, the buffer is acetic acid. While boric acid can be used as a buffer, most preferably, the aqueous nickel electroplating compositions of the invention are free of boric acid. The buffers can be added in amounts as needed to maintain a desired pH range.

Optionally, one or more brighteners can be included in the aqueous nickel electroplating compositions. Optional brighteners include, but are not limited to, 2-butyne-1,4-diol, 1-butyne-1,4-diol ethoxylate, 1-ethynylcyclohexylamine and propargyl alcohol. Such brighteners can be included in amounts of 0.5 g/L to 10 g/L. Preferably, such optional brighteners are excluded from the aqueous nickel electroplating compositions.

Optionally, one or more surfactants can be included in the aqueous nickel electroplating compositions of the invention. Such surface active agents include, but are not limited to, ionic surfactants such as cationic and anionic surfactants, non-ionic surfactants and amphoteric surfactants. Surfactants can be used in conventional amounts such as 0.05 gm/L to 30 gm/L.

Examples of surfactants which can be used are anionic surfactants sodium di(1,3-dimethylbutyl) sulfosuccinate, sodium-2-ethylhexylsulfate, sodium diamyl sulfosuccinate, sodium lauryl sulfate, sodium lauryl ether-sulfate, sodium di-alkylsulfosuccinates and sodium dodecylbenzene sulfonate, and cationic surfactants such as quaternary ammonium salts such as perfluorinated quaternary amines.

Other optional additives can include, but are not limited to, levelers, chelating agents, complexing agents and biocides. Such optional additives can be included in conventional amounts.

Since the nickel electroplating compositions of the invention are environmentally friendly, they are free of compounds such as coumarin, formaldehyde and preferably free of boric acid. In addition, the nickel electroplating compositions are free of allylsulfonic acid.

Except for unavoidable metal contaminants, the aqueous nickel electroplating compositions of the present invention are also free of any alloying metals or metals which typically are included in metal plating baths to brighten or improve the luster of the metal deposit. The aqueous nickel electroplating compositions of the present invention deposit bright and uniform nickel metal layers which have substantially smooth surfaces with a minimum number of components in the electroplating compositions.

Preferably, the aqueous environmentally friendly nickel electroplating compositions of the present invention are composed of one or more sources of nickel ions, wherein the one or more sources of nickel ions provide a sufficient amount of nickel ions in solution to plate nickel and the corresponding counter anions from the one or more sources of nickel ions, one or more N-benzylpyridinium sulfonate compounds, one or more sources of acetate ions and the corresponding counter cations, sodium saccharinate, optionally, one or more sources of chloride ions and corresponding counter cations, optionally, one or more surfactants, and water.

More preferably, the environmentally friendly aqueous nickel electroplating compositions of the present invention are composed of one or more sources of nickel ions, wherein the one or more sources of nickel ions provide a sufficient amount of nickel ions in solution to plate nickel and the corresponding counter anions from the one or more sources of nickel ions, N-benzylpyridinium-3-sulfonate, one or more sources of acetate ions and the corresponding counter cations, sodium saccharinate, optionally, one or more sources of chloride ions and corresponding cations, optionally, one or more surfactants, and water.

Even more preferably, the environmentally friendly aqueous nickel electroplating compositions of the present invention are composed of one or more sources of nickel ions, wherein the one or more sources of nickel ions provide a sufficient amount of nickel ions in solution to plate nickel and the corresponding counter anions from the one or more sources of nickel ions, N-benzylpyridinium-3-sulfonate, sodium saccharinate, acetate ions, wherein a source of acetate ions is chosen from one or more of nickel acetate, nickel acetate tetrahydrate and acetic acid, one or more sources of chloride ions and corresponding cations, optionally, one or more surfactants, and water.

The N-benzylpyridinium sulfonate zwitterion compounds of the present invention are analyzable at low concentrations of around 2 ppm using conventional UV-visible spectroscopy which is an economically efficient and commonly used analytical tool for the electroplating industry. This enables workers in the nickel electroplating industry to more accurately monitor the concentrations of the N-benzylpyridinium sulfonate in compositions during electroplating such that the plating process can be maintained at optimum performance and provide a more efficient and economical electroplating method.

The aqueous environmentally friendly nickel electroplating compositions of the present invention can be used to deposit nickel layers on various substrates, both conductive and semiconductive substrates. Preferably, the substrates on which nickel layers are deposited are copper and copper alloy substrates. Such copper alloy substrates include, but are not limited to, brass and bronze. The electroplating composition temperatures during plating can range from room temperature to 70° C., preferably, from 30° C. to 60° C., more preferably, from 40° C. to 60° C. The nickel electroplating compositions are preferably under continuous agitation during electroplating.

The nickel metal electroplating method of the present invention includes providing the aqueous nickel electroplating composition and contacting the substrate with the aqueous nickel electroplating composition such as by immersing the substrate in the composition or spraying the substrate with the composition. Applying a current with a conventional rectifier where the substrate functions as a cathode and there is present a counter electrode or anode. The anode can be any conventional soluble or insoluble anode used for electroplating nickel metal adjacent a surface of a substrate. The aqueous nickel electroplating compositions of the present invention enable deposition of bright and uniform nickel metal layers over broad current density ranges. Many substrates are irregular in shape and typically have discontinuous metal surfaces. Accordingly, current densities can vary across the surface of such substrates typically resulting in non-uniform metal deposits during plating. Also, the surface brightness is typically irregular with combinations of matte and bright deposits. Nickel metal plated from the nickel electroplating compositions of the present invention enable substantially smooth, uniform, bright nickel deposits across the surface of the substrates, including irregular shaped substrates. In addition, the environmentally friendly nickel electroplating compositions of the present invention enable plating of substantially uniform and bright nickel deposits to cover scratches and polishing marks on metal substrates.

Current densities can range from 0.1 ASD or higher. Preferably, the current densities range from 0.5 ASD to 70 ASD, more preferably, from 1 ASD to 40 ASD, even more preferably, from 5 ASD to 30 ASD. When the nickel electroplating compositions are used in reel-to-reel electroplating, the current densities can range from 50 ASD to 70 ASD, more preferably from 5 ASD to 50 ASD, even more preferably from 5 ASD to 30 ASD. When nickel electroplating is done at current densities from 60 ASD to 70 ASD, preferably, the one or more sources of nickel ions are included in the environmentally friendly nickel electroplating compositions in amounts of 90 g/L or greater, more preferably, from 90 g/L to 150 g/L, even more preferably, from 90 g/L to 125 g/L, most preferably, from 90 g/L to 100 g/L.

In general, the thickness of the nickel metal layers can range from 1 μm or greater. Preferably, the nickel layers have thickness ranges of 1 μm to 100 μm, more preferably, from 1 μm to 50 μm, even more preferably, from 1 μm to 10 μm.

Although the aqueous nickel electroplating compositions can be used to plate nickel metal layers on various types of substrates, preferably, the aqueous nickel electroplating compositions are used to plate nickel underlayers. More preferably, the aqueous nickel electroplating compositions are used to electroplate nickel metal underlayers to inhibit pore formation or pitting of gold and gold alloys and to inhibit corrosion of metals below the gold or gold alloy layer of plated articles.

A nickel metal underlayer is electroplated on a base substrate to a thickness of 1 μm to 20 μm, preferably, from 1 μm to 10 μm, more preferably, from 1 μm to 5 μm. The substrate can include, but is not limited to, one or more metal layers of copper, copper alloy, iron, iron alloy, stainless steel; or the substrate can be a semiconductor material such as a silicon wafer or other type of semiconductor material and, optionally, treated by conventional methods known in the plating arts to make the semiconductor material sufficiently conductive to receive one or more metal layers. Copper alloys include, but are not limited to, copper/tin, copper/silver, copper/gold, copper/silver/tin, copper/beryllium, and copper/zinc. Iron alloys include, but are not limited to, iron/copper and iron/nickel. Examples of substrates which can include a gold or gold alloy layer adjacent a nickel metal underlayer are components of electrical devices such as printed wiring boards, connectors, bumps on semiconductor wafers, leadframes, electrical connectors, connector pins, and passive components such as resistors and capacitors for IC units.

An example of a typical substrate with nickel underlayer is a lead frame or electrical connector such as a connector pin which is typically composed of copper or copper alloy. An example of a typical copper alloy for a connector pin is a beryllium/copper alloy. Nickel electroplating of an underlayer is done at the temperature ranges disclosed above. Current density ranges for plating nickel underlayers can be from 0.1 ASD to 50 ASD, preferably, from 1 ASD to 40 ASD and, more preferably, from 5 ASD to 30 ASD.

After the nickel metal underlayer is electroplated adjacent a metal, metal alloy layer or semiconductor surface of the substrate, a layer of gold or gold alloy is deposited adjacent the nickel metal layer. The gold or gold alloy layer can be deposited adjacent the nickel metal underlayer using conventional gold and gold alloy deposition processes such as physical vapor deposition, chemical vapor deposition, electroplating, electroless metal plating, including immersion gold plating. Preferably, the gold or gold alloy layer is deposited by electroplating.

Conventional gold and gold alloy plating baths can be used to plate gold and gold alloy layers of the present invention. An example of a commercially available hard gold alloy electroplating bath is RONOVEL™ LB-300 Electrolytic Hard Gold electroplating bath (available from Dow Electronic Materials, Marlborough, Mass.).

Sources of gold ions for gold and gold alloy plating baths include, but are not limited to, potassium gold cyanide, sodium dicyanoaurate, ammonium dicyanoaurate, potassium tetracyanoaurate, sodium tetracyanoaurate, ammonium tetracyanoaurate, dichloroauric acid salts; tetrachloroauric acid, sodium tetrachloroaurate, ammonium gold sulfite, potassium gold sulfite, sodium gold sulfite, gold oxide and gold hydroxide. The sources of gold can be included in conventional amounts, preferably, from 0.1 g/L to 20 g/L or, more preferably, from 1 g/L to 15 g/L.

Alloying metals include, but are not limited to, copper, nickel, zinc, cobalt, silver, platinum cadmium, lead, mercury, arsenic, tin, selenium, tellurium, manganese, magnesium, indium, antimony, iron, bismuth and thallium. Typically, the alloying metal is cobalt or nickel which provides a hard gold alloy deposit. Sources of alloying metals are well known in the art. The sources of alloying metals are included in the bath in conventional amounts and vary widely depending on the type of alloying metal used.

Gold and Gold alloy baths can include conventional additives such as surfactants, brighteners, levelers, complexing agents, chelating agents, buffers and biocides. Such additives are included in conventional amounts and are well known to those of skill in the art.

In general, current densities for electroplating gold and gold alloy layers can range from 1 ASD to 40 ASD, or such as from 5 ASD to 30 ASD. Gold and gold alloy plating bath temperatures can range from room temperature to 60° C.

After the gold or gold alloy layer is deposited adjacent the nickel metal underlayer, typically, the substrate with the metal layers undergoes thermal aging. Thermal aging may be done by any suitable method known in the art. Such methods include, but are not limited to, steam aging and dry baking. The nickel metal underlayer inhibits surface diffusion of less noble metals into the gold or gold alloy layer, thus solderability is improved.

The following examples are included to further illustrate the invention but are not intended to limit its scope.

EXAMPLE 1 (INVENTION)

Nickel Electroplating Baths of the Invention Containing N-benylpyridinium-3-sulfonate and Hull Cell Plating Results Three (3) aqueous based nickel electroplating baths were prepared having the components and amounts of each component as shown in the table below.

TABLE 1

| Component | Bath 1 | Bath 2 | Bath 3 |
|---|---|---|---|
| Nickel ions (total) | 50 g/L | 50 g/L | 50 g/L |
| Chloride ions (total) | 3 g/L | 3 g/L | 3 g/L |
| Acetate ions (total) | 13.5 g/L | 13.5 g/L | 13.5 g/L |
| Nickel chloride hexahydrate | 10 g/L | 10 g/L | 10 g/L |
| Nickel acetate tetrahydrate | 25 g/L | 25 g/L | 25 g/L |
| Nickel sulfate hexahydrate | 185 g/L | 185 g/L | 185 g/L |
| Acetic acid | 1.35 g/L | 1.35 g/L | 1.35 g/L |
| Sodium saccharinate | 0.5 g/L | 0.5 g/L | 0.5 g/L |
| N-benylpyridinium-3-sulfonate | 100 ppm | 200 ppm | 250 ppm |
| Water | To one liter | To one liter | To one liter |

Each bath was placed in an individual Hull cell with a brass panel and a ruler along the base of each Hull cell with calibrations of varying current densities or plating speeds. The anode was a sulfurized nickel electrode. Nickel electroplating was done for each bath for 5 minutes. The baths were agitated with the Hull cell paddle agitator during the entire plating time. The baths were at a pH of 4.6 and the temperatures of the baths were at 60° C. There was no detectable odor from acetate. The current was 3 A. DC current was applied producing a nickel layer on the brass panel deposited with a continuous current density range of 0.1-12 ASD. After plating, the panels were removed from the Hull cells, rinsed with DI water and air dried. The nickel deposits from each Hull cell appeared bright and the nickel deposits appeared uniform along the entire current density range.

EXAMPLE 2 (INVENTION)

Nickel Electroplating Baths of the Invention and Rotating Cylinder Cell Plating Results Each of the three (3) nickel electroplating baths of Example 1 was placed in a cylindrical plating cell into which a rotating brass cylindrical cathode and a sulfurized nickel anode were inserted. Nickel electroplating was done using DC current of an amount appropriate to achieve high DC electroplating speeds of 10 ASD, 20 ASD, 30 ASD, 40 ASD, 50 ASD and 60 ASD which included speeds similar to (10-30 ASD) and in excess of (40-60 ASD) conventional reel-to-reel electroplating except the rotation of the cathode was at higher speeds of 1000 rpms, which simulated agitation that was higher than the conventional reel-to-reel electroplating. The nickel plating was done until the deposit thickness reached 8.5 μm at 60° C. The pH of each bath was 4.6.

After plating, the cylindrical cathodes were removed from the cylindrical plating cells, rinsed with deionized water and air dried. The nickel deposits from each rotating cylinder Hull cell appeared bright and the nickel deposits appeared uniform from current densities of 10 ASD to 50 ASD. The nickel deposits at 60 ASD appeared uniform; however, they were dull in appearance.

EXAMPLE 3 (INVENTION)

Nickel Electroplating Baths of the Invention and Rotating Cylinder Cell Plating Results at Higher Nickel Ion Concentrations The method disclosed in Example 2 above was repeated except the three (3) nickel electroplating baths had the formulations in the table below and the current densities in the rotating cylinder Hull cells were 40 ASD, 50 ASD, 60 ASD, 70 ASD and 80 ASD. The remainder of the electroplating conditions was as described in Example 2.

TABLE 2

| Component | Bath 4 | Bath 5 | Bath 6 |
|---|---|---|---|
| Nickel ions (total) | 90 g/L | 90 g/L | 90 g/L |
| Chloride ions (total) | 3 g/L | 3 g/L | 3 g/L |
| Acetate ions (total) | 13.5 g/L | 13.5 g/L | 13.5 g/L |
| Nickel chloride hexahydrate | 10 g/L | 10 g/L | 10 g/L |
| Nickel acetate tetrahydrate | 25 g/L | 25 g/L | 25 g/L |
| Nickel sulfate hexahydrate | 365 g/L | 365 g/L | 365 g/L |
| Acetic acid | 5 g/L | 5 g/L | 5 g/L |
| Sodium saccharinate | 0.5 g/L | 0.5 g/L | 0.5 g/L |
| N-benylpyridinium-3-sulfonate | 100 ppm | 200 ppm | 250 ppm |
| Water | To one liter | To one liter | To one liter |

After plating, the cylindrical cathodes were removed from the cylindrical plating cells, rinsed with deionized water and air dried. The nickel deposits from each cylindrical cathode appeared bright and the nickel deposits appeared uniform from current densities of 40 ASD to 70 ASD. The nickel deposits at 80 ASD appeared uniform; however, they were dull in appearance.

EXAMPLE 4 (COMPARATIVE)

Comparative Nickel Electroplating Baths Containing 1-benylpyridinium-3-carboxylate and Hull Cell Plating Results Four (4) aqueous based nickel electroplating baths were prepared having the components and amounts of each component as shown in the table below.

TABLE 3

| Component | Comparative Bath 1 | Comparative Bath 2 | Comparative Bath 3 | Comparative Bath 4 |
|---|---|---|---|---|
| Nickel ions (total) | 50 g/L | 50 g/L | 50 g/L | 50 g/L |
| Chloride ions (total) | 3 g/L | 3 /L | 3 g/L | 3 g/L |
| Acetate ions (total) | 13.5 g/L | 13.5 g/L | 13.5 g/L | 13.5 g/L |
| Nickel chloride hexahydrate | 10 g/L | 10 g/L | 10 g/L | 10 g/L |
| Nickel acetate tetrahydrate | 25 g/L | 25 g/L | 25 g/L | 25 g/L |
| Nickel sulfate hexahydrate | 185 g/L | 185 g/L | 185 g/L | 185 g/L |
| Acetic acid | 1.35 g/L | 1.35 g/L | 1.35 g/L | 1.35 g/L |
| Sodium saccharinate | 0.5 g/L | 0.5 g/L | 0.5 g/L | 0.5 g/L |
| 1-benyl-pyridinium-3-carboxylate | 25 ppm | 50 ppm | 100 ppm | 200 ppm |
| Water | To one liter | To one liter | To one liter | To one liter |

(II)

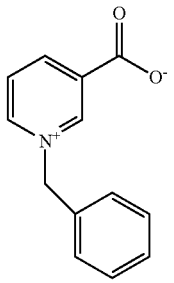

1-benzylpyridinium-3-carboxylate

Each bath was placed in an individual Hull cell with a brass panel and a ruler along the base of each Hull cell with calibrations of varying current densities or plating speeds. The anode was a sulfurized nickel electrode. Nickel electroplating was done for each bath for 5 minutes. The baths were agitated with the Hull cell paddle agitator during the entire plating time. The baths were at a pH of 4.6 and the temperatures of the baths were at 60° C. There was no detectable odor from acetate. The current was 3 A. DC current was applied, producing a nickel layer on the brass panel deposited with a continuous current density range of 0.1-12ASD. After plating, the panels were removed from the Hull cells, rinsed with DI water and air dried. With the exception of the nickel deposit from the bath which included 100 ppm of 1-benzylpyridinium-3-carboxylate, Comparative Bath 3, the uniformity of the nickel deposits' brightness were not uniform but irregular along the entire current density range.

EXAMPLE 5 (COMPARATIVE)

Comparative Nickel Electroplating Baths Containing Pyridinium Propyl Sulfonate Compounds and Hull Cell Plating Results Three (3) aqueous based nickel electroplating baths were prepared having the components and amounts of each component as shown in the table below.

TABLE 4

| Component | Comparative Bath 5 | Comparative Bath 6 | Comparative Bath 7 |
|---|---|---|---|
| Nickel ions (total) | 50 g/L | 50 g/L | 50 g/L |
| Chloride ions (total) | 3 g/L | 3 g/L | 3 g/L |
| Acetate ions (total) | 13.5 g/L | 13.5 g/L | 13.5 g/L |
| Nickel chloride hexahydrate | 10 g/L | 10 g/L | 10 g/L |
| Nickel acetate tetrahydrate | 25 g/L | 25 g/L | 25 g/L |
| Nickel sulfate hexahydrate | 185 g/L | 185 g/L | 185 g/L |
| Acetic acid | 5 g/L | 5 g/L | 5 g/L |
| Sodium saccharinate | 0.5 g/L | 0.5 g/L | 0.5 g/L |
| Pyridinium propyl sulfonate | 200 ppm | — | — |
| Pyridinium hydroxypropyl sulfonate | — | 200 ppm | — |
| 3-(3-carbamoylpyridin-1-ium-1-yl) propane-1-sulfonate | — | — | 100 ppm |
| Water | To one liter | To one liter | To one liter |

(III)

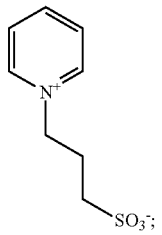

(IV)

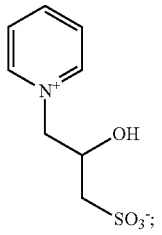

pyridinium propyl sulfonate; pyridinium hydroxypropyl sulfonate;

(V)

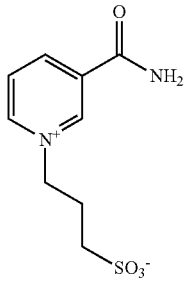

3-(3-carbamoylpyridin-1-ium-1-yl)propane-1-sulfonate

Each bath was placed in an individual Hull cell with a brass panel and a ruler along the base of each Hull cell with calibrations of varying current densities or plating speeds. The anode was a sulfurized nickel electrode. Nickel electroplating was done for each bath for 5 minutes. The baths were agitated with the Hull cell paddle agitator during the entire plating time. The baths were at a pH of 4.6 and the temperatures of the baths were at 60° C. There was no detectable odor from acetate. The current was 3 A. DC current was applied, producing a nickel layer on the brass panel deposited with a continuously current density range of 0.1-12ASD. After plating, the panels were removed from the Hull cells, rinsed with DI water and air dried. There was no indication of uniform nickel plating over the entire current density range for any of Comparative Baths 5-7. Comparative Baths 5-6 plated nickel deposits which were sporadically bright interspersed with areas of matte deposits. Comparative Bath 7 plated a deposit which had dendritic growths in addition to sporadic bright and matte areas. Dendrites are undesirable in plated articles because they can cause electrical shorts in the articles.

EXAMPLE 6 (COMPARATIVE)

Comparative Nickel Electroplating Baths Containing 1-Methylpyridinium-3-Sulfonate and Hull Cell Plating Results Four (4) aqueous based nickel electroplating baths were prepared having the components and amounts of each component as shown in the table below.

TABLE 5

| Component | Comparative Bath 8 | Comparative Bath 9 | Comparative Bath 10 | Comparative Bath 11 |
|---|---|---|---|---|
| Nickel ions (total) | 50 g/L | 50 g/L | 50 g/L | 50 g/L |
| Chloride ions (total) | 3 g/L | 3 g/L | 3 g/L | 3 g/L |
| Acetate ions (total) | 13.5 g/L | 13.5 g/L | 13.5 g/L | 13.5 g/L |
| Nickel chloride hexahydrate | 10 g/L | 10 g/L | 10 g/L | 10 g/L |
| Nickel acetate tetrahydrate | 25 g/L | 25 g/L | 25 g/L | 25 g/L |
| Nickel sulfate hexahydrate | 185 g/L | 185 g/L | 185 g/L | 185 g/L |
| Acetic acid | 1.35 g/L | 1.35 g/L | 1.35 g/L | 1.35 g/L |
| Sodium saccharinate | 0.5 g/L | 0.5 g/L | 0.5 g/L | 0.5 g/L |

TABLE 5-continued

| Component | Comparative Bath 8 | Comparative Bath 9 | Comparative Bath 10 | Comparative Bath 11 |
|---|---|---|---|---|
| 1-methyl-pyridinium-3-sulfonate | 25 ppm | 100 ppm | 150 ppm | 200 ppm |
| Water | To one liter | To one liter | To one liter | To one liter |

(VI)

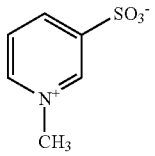

1-methylpyridinium-3-sulfonate

Each bath was placed in an individual Hull cell with a brass panel and a ruler along the base of each Hull cell with calibrations of varying current densities or plating speeds. The anode was a sulfurized nickel electrode. Nickel electroplating was done for each bath for 5 minutes. The baths were agitated with the Hull cell paddle agitator during the entire plating time. The baths were at a pH of 4.6 and the temperatures of the baths were at 60° C. There was no detectable odor from acetate. The current was 3 A. DC current was applied producing a nickel layer on the brass panel deposited with a continuous current density range of 0.1-12ASD. After plating, the panels were removed from the Hull cells, rinsed with DI water and air dried. There was no indication of bright and uniform nickel plating over the entire current density range for any of Comparative Baths 8-11. The deposits had bright areas interspersed with matte areas.

EXAMPLE 7

Leveling Performance of Nickel Electroplating Bath of the Invention Containing N-Benzylpyridinium-3-Sulfonate Versus Comparative Nickel Electroplating Bath Containing Pyridinium Propyl Sulfonate Two (2) aqueous based nickel electroplating baths were prepared having the components and amounts of each component as shown in the table below.

TABLE 6

| Component | Bath 7 | Comparative Bath 12 |
|---|---|---|
| Nickel ions (total) | 50 g/L | 50 g/L |
| Chloride ions (total) | 3 g/L | 3 g/L |
| Acetate ions (total) | 13.5 g/L | 13.5 g/L |
| Nickel chloride hexahydrate | 10 g/L | 10 g/L |
| Nickel acetate tetrahydrate | 25 g/L | 25 g/L |
| Nickel sulfate hexahydrate | 185 g/L | 185 g/L |
| Acetic acid | 5 g/L | 5 g/L |
| Sodium saccharinate | 1.35 g/L | 1.35 g/L |
| N-benzylpyridinium-3-sulfonate | $1 \times 10^{-3}$ mole/L (250 ppm) | — |
| Pyridinium propyl sulfonate | — | $1 \times 10^{-3}$ mole/L |

TABLE 6-continued

| Component | Bath 7 | Comparative Bath 12 |
|---|---|---|
| | | (201 ppm) |
| Water | To one liter | To one liter |

500 mL of each nickel electroplating bath was placed in a separate one liter plating cell with a sulfurized nickel anode. The cathode was a brass panel having dimensions 5 cm×5 cm. The pH of each bath was 4.6 and the temperature of the nickel baths were 60° C. The current density during nickel electroplating was 5 ASD. Nickel electroplating was done for 2 minutes. After nickel plating the panels were removed from the plating cells, rinsed with DI water and air dried.

Figure 2:
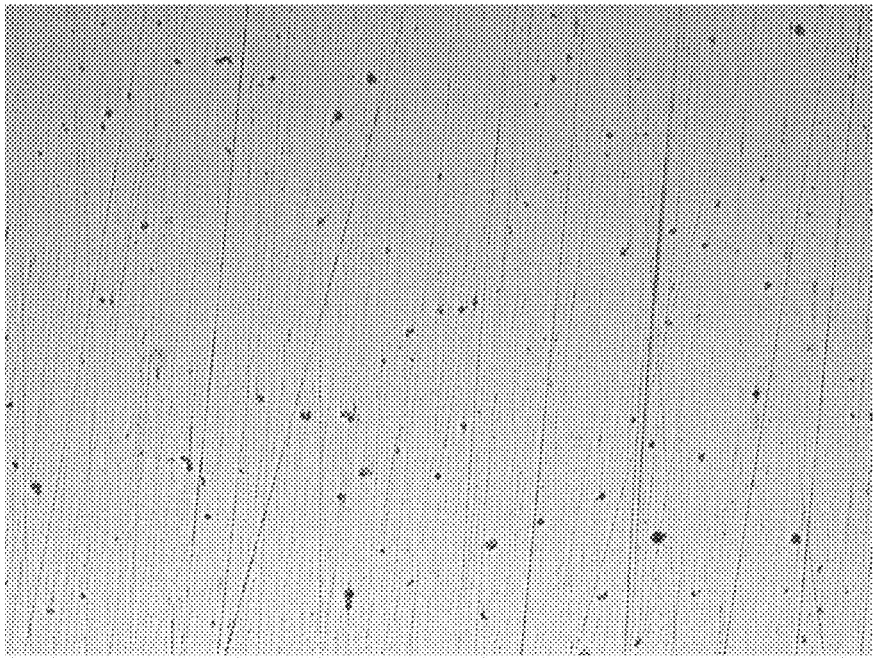
FIG. 2 is a photograph at 50× of a brass panel nickel plated with a comparative nickel electroplating bath.

Each nickel plated panel was then placed under a LEICA DM13000M optical microscope. FIG. 1 is a photograph at 50× taken with the optical microscope showing the nickel deposit of Bath 7 (invention). The nickel deposit was bright and substantially uniform with few visible pits (dark spots) and barley visible scratches (striations). In contrast, FIG. 2 is a photograph of the nickel plated panel of Comparative Bath 12. Although the nickel was bright, the photograph shows substantial pitting (dark spots) and very visible scratches (striations). The nickel deposit plated from Bath 7 showed marked improvement over the nickel plated from Comparative Bath 12.

Figure 3:
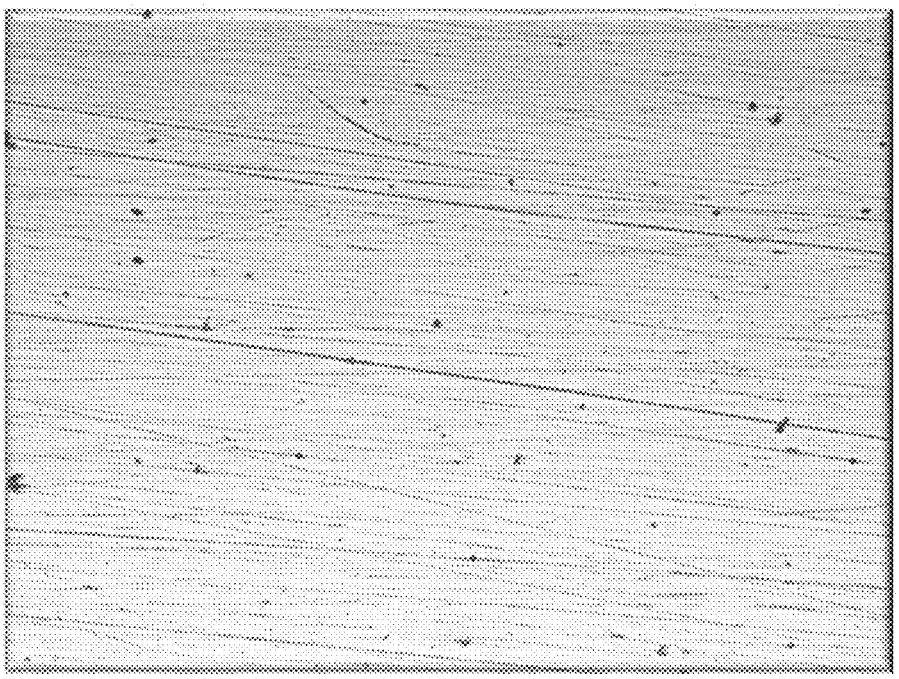
FIG. 3 is a photograph at 50× of an unplated polished brass panel showing scratches and pits due to a polishing slurry.

FIG. 3 is a photograph at 50× of a brass panel prior to plating with nickel. The photographs shows extensive scratches and pitting due to polishing abrasives. FIG. 3 appears substantially the same as FIG. 2 plated with the nickel composition of Comparative Bath 12. In contrast, FIG. 1 shows that the nickel plating composition of Bath 12 enabled a nickel deposit which filled in and coats substantially all of the scratches and pits of the brass panel.

EXAMPLE 8

Nitric Acid Vapor Test of Hard Gold Alloy Deposit with Nickel Underlayer

Two (2) aqueous nickel electroplating baths having the formulations disclosed in the table below were prepared.

TABLE 7

| Component | Bath 2 | Comparative Bath 13 |
|---|---|---|
| Nickel ions (total) | 50 g/L | 135 g/L |
| Chloride ions (total) | 3 g/L | 2.4 g/L |
| Acetate ions (total) | 13.5 g/L | — |
| Nickel chloride hexahydrate | 10 g/L | 8 g/L |
| Nickel acetate tetrahydrate | 25 g/L | — |
| Nickel sulfate hexahydrate | 185 g/L | 550 g/L |
| Acetic acid | 1.35 g/L | — |
| Sodium saccharinate | 0.6 g/L | 0.3 g/L |
| Boric acid | — | 35 g/L |
| N-benzylpyridinium-3-sulfonate | 200 ppm | — |
| Naphthalene trisulfonic acid, trisodium salt | — | 13 ppm |
| Water | To one liter | To one liter |

42 two-sided 1.25 cm thick beryllium/copper (Be/Cu) alloy connector pins with irregular surfaces were electroplated with the nickel electroplating Bath 2 and another 42 pins were electroplated with nickel electroplating Comparative Bath 13 in one liter plating cells. The pH of Bath 2 was 4.6 and the pH of Comparative Bath 13 was 3.6. The temperature of the nickel plating baths was around 60° C. The anode was a sulfurized nickel electrode. Electroplating was done at a current density of 5 ASD for a sufficient amount of time to electroplate a nickel layer on each connector pin for a target thickness of around 2 μm. The thickness of the nickel deposits were measured using XRF analysis with a conventional XRF spectrometer.

After a layer of nickel was plated on the connector pins, the pins were removed from the baths, placed in a 10% v/v aqueous solution of sulfuric acid for 30 seconds, then transferred to a plating cell containing RONOVEL™ LB-300 Electrolytic Hard Gold plating bath (available from Dow Electronic Materials, Marlborough, Mass.) and each connector pin was then plated with a hard gold alloy layer for a target thickness of around 0.38 μm.

Gold alloy plating was done at 50° C. at a current density of 1 ASD. The anode was a platinized titanium electrode. The pH of the gold alloy bath was 4.3. After the pins were gold alloy plated, they were removed from the plating cells and air dried. Each pin was imaged to record the surface appearance of the pins prior to the corrosion test. Images of the surfaces of each pin were taken using a LEICA DM13000M optical microscope at 50× magnification. There were no observable signs of corrosion on any of the surfaces of the pins (both sides).

The gold alloy plated connector pins were then exposed to nitric acid vapors substantially according to ASTM B735-06 Nitric Acid Vapor test to evaluate the corrosion inhibiting ability of the nickel underlayers from the two types of nickel plating baths. Each connector pin was hung in a 500 mL glass vessel where the environment within the glass vessel was saturated with 70 wt % nitric acid vapors at 22° C. The pins were exposed to the nitric acid vapors for around 2 hours. The nitric acid vapor treated pins were then removed from the glass vessel, baked at 125° C., then allowed to cool in a desiccator prior to analysis.

Images of the surfaces (both sides) of each pin were taken using LEICA DM13000M optical microscope at 50×. Any corrosion spots as observable under the optical microscope were colored in by hand using GIMP.

Figure 4:
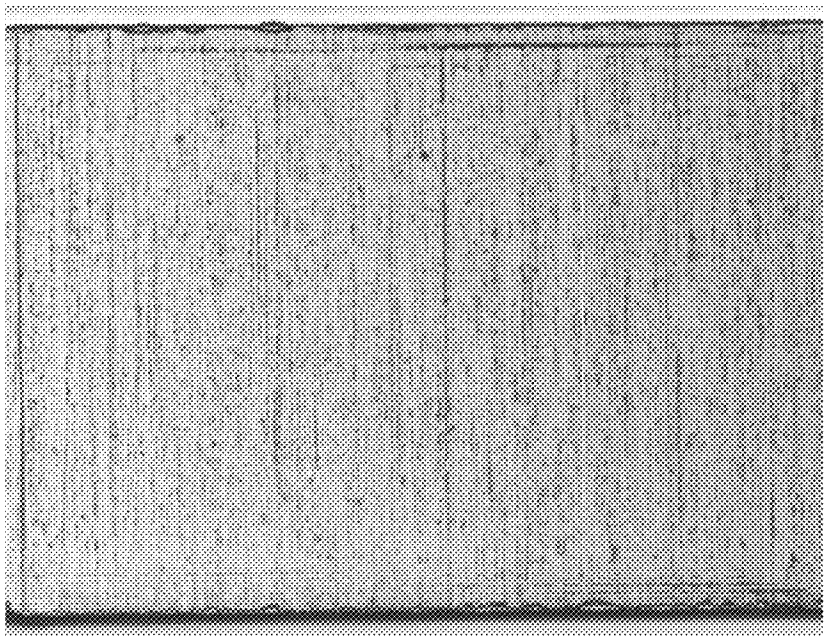
FIG. 4 is a photograph at 50× of a gold plated beryllium/copper alloy connector pin with a nickel under layer plated from a nickel electroplating bath of the invention after exposure to nitric acid vapor for 2 hours according to ASTM B735.
Figure 5:
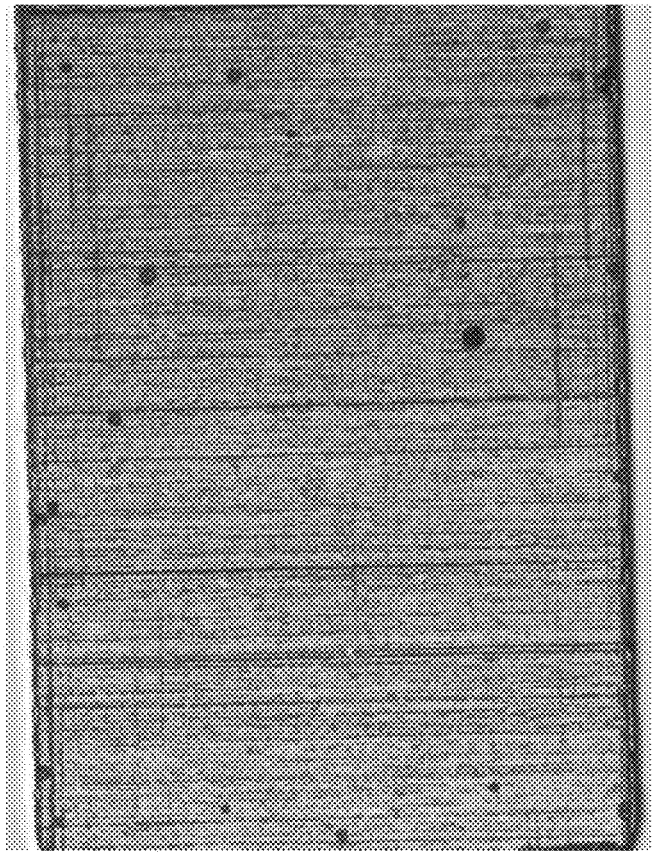
FIG. 5 is a photograph at 50× of a gold plated beryllium/copper alloy connector pin with a nickel under layer plated from a comparative nickel electroplating bath after exposure to nitric acid vapor for 2 hours according to ASTM B735.

The number of pixels comprising the corrosion spots were counted by the GIMP software to determine the % corroded areas of each side of each connector pin. One side of the pins plated with Bath 2 had an average % corroded area of 0.2% and the other side had an average % corroded area of 0.1%. FIG. 4 is a 50× photograph taken with the LEICA DM13000M optical microscope of one of the gold alloy plated connector pins plated with a nickel underlayer from Bath 2. One corrosion spot (black spot) is visible on the pin surface. In contrast, one side of the pins plated with Comparative Bath 13 had an average % corroded area of 1% and on the other side had an average % corroded area of 0.4%. FIG. 5 is a 50× photograph taken with the optical microscope of one of the gold alloy plated connector pins plated with a nickel underlayer from Comparative Bath 13. Numerous corrosion spots (black spots) are observable on the surface of the gold alloy deposit. The black spots were due to corrosion of the underlying nickel layer observable by pores formed in the surface of the gold alloy layer during nickel plating. The connector pins electroplated with the nickel underlayer from Bath 2 of the invention show significant corrosion inhibition in contrast to the pins electroplated with a nickel underlayer from comparative Bath 13.

EXAMPLE 9

Ductility of Nickel Deposits

An elongation test was performed on the nickel deposits electroplated from Bath 2 of the invention and Comparative Bath 13 disclosed in Example 8 above to determine ductility of the Nickel deposits. The ductility test was done substantially according to industrial standard ASTM B489-85: Bend Test for Ductility of Electrodeposited and Autocatalytically Deposited Metal Coatings on Metals.

A plurality of brass panels was provided. Half of the brass panels were plated with 2 μm of nickel from Bath 2 and the other half are plated with 2 μm of nickel from Bath 13. Electroplating was done at 60° C. at 5 ASD. The plated panels were bent 180° over mandrels of various diameters ranging from 0.32 cm to 1.3 cm and then examined under a 50× microscope for cracks in the deposit. The smallest diameter tested for which no cracks were observed was then used to calculate the degree of elongation of the deposit. Elongation for the nickel deposit from both Bath 2 and Bath 13 were found to be 11.2% which is considered good ductility for commercial nickel bath deposits. The results showed that the ductility of the nickel plated from Bath 2 was as good as the Comparative Bath 13.

What is claimed is:

1. A nickel electroplating composition comprising one or more sources of nickel ions, one or more sources of acetate ions, sodium saccharinate and one or more N-benzylpyridinium sulfonate compounds having formula:

(I)

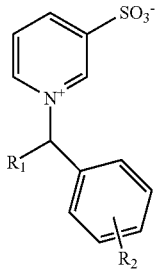

wherein $R_1$ and $R_2$ are independently chosen from hydrogen, hydroxyl and ($C_1$-$C_4$) alkyl.

2. The nickel electroplating composition of claim 1, wherein the one or more N-benzylpyridinium sulfonate compounds is in amounts of at least 0.5 ppm.

3. The nickel electroplating composition of claim 1, wherein the N-benzylpyridinium sulfonate compound is N-benzylpyridinium-3-sulfonate.

4. The nickel electroplating composition of claim 1, further comprising one or more sources of chloride.

5. The nickel electroplating composition of claim 1, further comprising one or more surfactants.

6. The nickel electroplating composition of claim 1, wherein the nickel electroplating composition has a pH of 2 to 6.

7. A method of electroplating nickel metal on a substrate comprising:

a) providing the substrate;

b) contacting the substrate with a nickel electroplating composition comprising one or more sources of nickel ions, one or more sources of acetate ions, sodium saccharinate and one or more N-benzylpyridinium sulfonate compounds having formula:

(I)

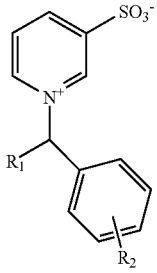

wherein $R_1$ and $R_2$ are independently chosen from hydrogen, hydroxyl and ($C_1$-$C_4$) alkyl; and c) applying an electric current to the nickel electroplating composition and substrate to electroplate a bright and uniform nickel deposit adjacent the substrate.

8. The method of claim 7, wherein the electric current has a current density of at least 0.1 ASD.

9. The method of claim 7, wherein the one or more N-benzylpyridinium sulfonate compounds are in amounts of at least 0.5 ppm.

10. The method of claim 7, wherein the N-benzylpyridinium sulfonate compound is N-benzylpyridinium-3-sulfonate.

11. The method of claim 7, wherein the nickel electroplating composition further comprises one or more sources of chloride.

12. The method of claim 7, wherein the nickel electroplating composition further comprises one or more surfactants.

13. The method of claim 7, wherein the nickel electroplating composition has a pH of 2 to 6.

14. The method of claim 7, further comprising depositing a gold or gold alloy layer adjacent the bright and uniform nickel deposit.

* * * * *